US007570173B2

(12) United States Patent
Bittner

(10) Patent No.: US 7,570,173 B2
(45) Date of Patent: Aug. 4, 2009

(54) DEVICE TO DISSIPATE GASES CREATED IN THE EVENT OF A QUENCH OF A SUPERCONDUCTING MAGNET

(75) Inventor: Gerhard Bittner, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 345 days.

(21) Appl. No.: 11/510,146

(22) Filed: Aug. 24, 2006

(65) Prior Publication Data

US 2007/0103320 A1 May 10, 2007

(30) Foreign Application Priority Data

Aug. 24, 2005 (DE) ..... 10 2005 040 108

(51) Int. Cl.
*G08B 21/00* (2006.01)

(52) U.S. Cl. ..... 340/605; 340/610; 340/643; 505/879

(58) Field of Classification Search ..... 340/605, 340/610–611, 614, 616, 618, 622, 626, 632, 340/640, 643
See application file for complete search history.

(56) References Cited

U.S. PATENT DOCUMENTS 4,152,407 A * 5/1979 Fuchs ..... 423/360
4,989,989 A * 2/1991 Wolfe et al. ..... 374/107
5,084,229 A * 1/1992 Welsh et al. ..... 376/257
5,173,568 A * 12/1992 Parmer ..... 89/8
5,298,864 A * 3/1994 Muller et al. ..... 324/321
5,552,039 A * 9/1996 McBrayer et al. ..... 210/90
7,201,003 B2 * 4/2007 Clarke ..... 62/51.1

OTHER PUBLICATIONS

"General Safety Considerations for the Installation and Operation of Superconducting Magnet Systems," Bruker Biospin, Revision 1.11, Mar. 29, 2002, p. 17.

* cited by examiner

*Primary Examiner*—Benjamin C Lee
*Assistant Examiner*—Daniel Previl
(74) *Attorney, Agent, or Firm*—Schiff Hardin LLP

(57) ABSTRACT

Device for dissipation of gases created in the event of a quench of a superconducting magnet has a quench tube and a front sealing element closing the quench tube on the magnet side. The quench tube is sealed by a rear sealing element, and at least one sensor is associated with the tube segment closed by the sealing elements. The measurement values of the sensor represent a measure for the impermeability of the tube segment. The sensor communicates with an alarm emitter via which an alarm signal can be output upon detection of a leakage of the tube segment.

11 Claims, 1 Drawing Sheet

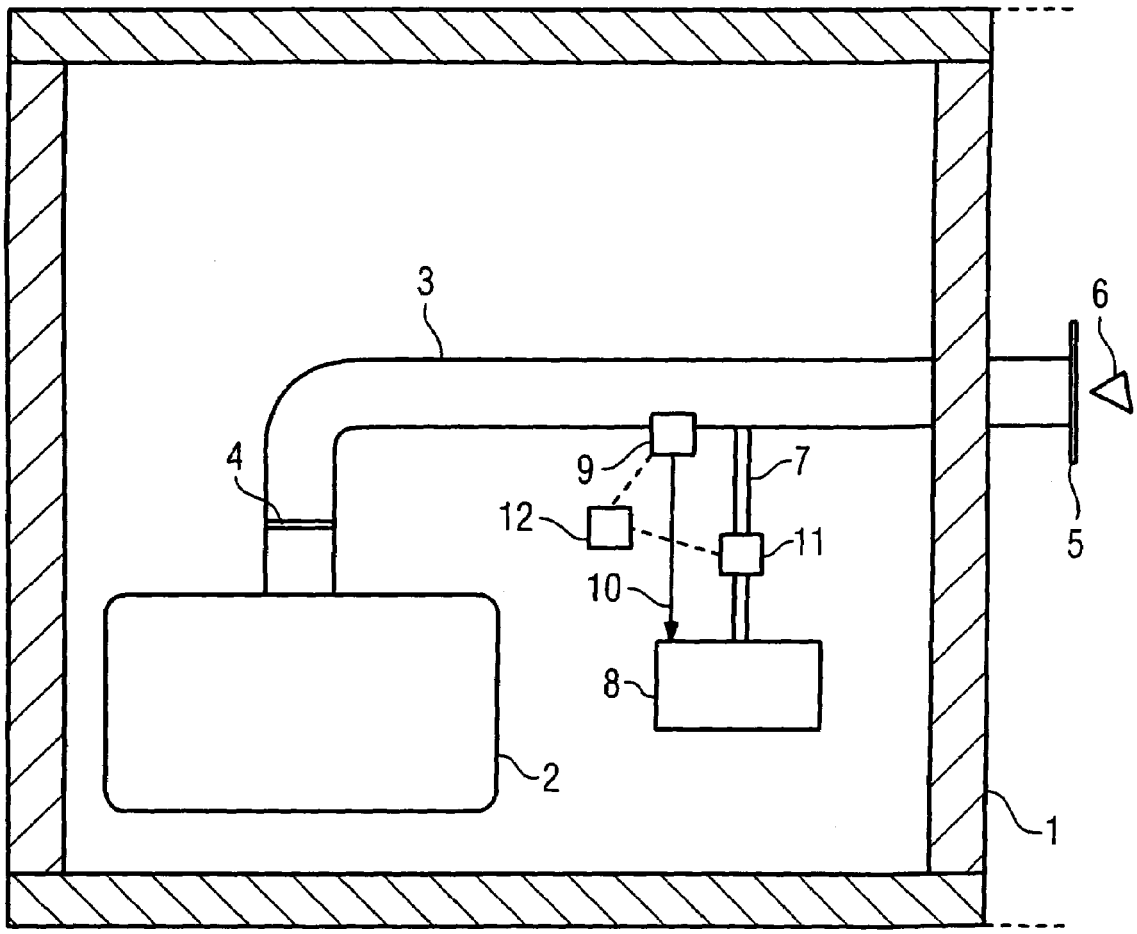
3
6
4
9
7
12
11
5
10
8
2
1

DEVICE TO DISSIPATE GASES CREATED IN THE EVENT OF A QUENCH OF A SUPERCONDUCTING MAGNET

BACKGROUND OF THE INVENTION

1. Field of the Invention

The present invention concerns a device to dissipate gases created upon the occurrence of a quench of a superconducting magnet of the type having a quench tube and a front sealing element sealing the quench tube on the magnet side.

2. Description of the Prior Art

A quench of a superconducting magnet can occur in very rare cases. A quench is a sudden transition from the superconducting state into the normally-conducting state. The energy of the magnetic field is thereby converted into heat. Since such magnets usually are cooled with a liquefied gas, in particular liquefied helium, this is vaporized by the created heat. In the case of a quench the gas must be conducted quickly and safely into the atmosphere.

Quench tubes are provided at magnets for this purpose. These are tubes with a diameter of approximately 20 to 40 cm that conduct the gas out from the building to the atmosphere in the event of a quench. It is extremely important that this quench tube is never leaky or blocked at all. If this were to occur the building can be flooded with helium in the case of a leaky quench tube, presenting the danger of asphyxiation for persons possibly present. Splitting of the magnet occurs in the event of a blockage. Since a quench occurs extremely rarely, continuous monitoring of the quench tube is atypical.

The quench tube normally is checked by an overview at regular intervals, for example yearly intervals. Slight leakages or blockages can arise in between these checks. The danger of a malfunction therefore always exists were a quench to occur.

SUMMARY OF THE INVENTION

An object of the invention is to design a quench tube such that an automated monitoring of its functionality is possible.

This object is achieved in accordance with the invention by a device of the aforementioned type wherein the quench tube is sealed by a rear sealing element, with at least one sensor associated with the tube segment being closed by the sealing element. The measurement values of this sensor represent a measure for the impermeability (leak tightness) of the tube segment. The sensor communicates with an alarm emitter via which an alarm signal can be output upon detection of a leakage of the tube segment.

A leakage (and therewith a safety risk) at the quench tube is immediately detected by the inventive device. If a leakage should occur, an alarm signal is output to operating personnel who can immediately initiate the necessary steps for fault search and repair. The fact that the quench tube is sealed gas tight from the environment offers yet another advantage. This precludes foreign bodies from penetrating unnoticed into the tube. Primarily water (which can cause slight damage) but not least also animals are among these foreign bodies, in addition to deposits and dirt. For example, it has been observed that birds tend to nest immediately in front of the quench tube exit. This is prevented by the sealing element of the present invention. Should one of the sealing elements be damaged by an animal or another circumstance, due to the arising leakage the alarm emitter provides a signal just as in the case of damage of the quench tube itself. A continuous monitoring of the functionality is thereby associated with the prevention of the penetration of foreign substances without a great deal of effort.

If the quench tube is also provided for the continuous exhaust vaporized helium to allow for normal dissipation thereof, an additional dissipation tube for these small gas quantities can be provided. Such a tube is to be fashioned significantly thinner than the quench tube, approximately 4 cm in diameter.

In a further embodiment of the invention it can be provided that the quench tube can be filled with a specific gas by a pump and the sensor is fashioned to measure foreign gas traces therein. If the quench tube forms a closed system, only a leakage can be responsible for a mixture of a foreign gas proportion. This is detected and an alarm can be triggered a certain foreign gas proportion being exceeded.

In a another embodiment a predetermined overpressure predominates in the quench tube and that the sensor, or a further sensor, is used as a pressure sensor. The gas can be a specific gas or air. A leakage would cause a decrease of the pressure to the external pressure. This pressure drop is measured by the pressure sensor. Given a predetermined pressure or pressure drop an alarm signal is output. A rather slight overpressure should thereby be selected that clearly lies below the pressure at which the sealing element opens in order to dissipate the vaporized gas created upon a quench.

A pump can be provided to keep the predetermined overpressure constant. There are very frequently slight leak losses in spite of the front and rear sealing element. The use of a pump ensures that the pressure is kept constant in spite of the small leak. The pressure therewith does not automatically adapt to the external pressure over time, which would either trigger an alarm signal or hinder the functionality of the device when pressure drops are measured.

A further sensor for measurement of the gas quantity supplied by the pump can be provided, with the alarm emitter accounting for the measurement values of both sensors or only one of the two sensors. The system can thus be set up particularly simply. A specific pressure at which the air or the gas in the quench tube should be kept is provided to the pump. In the case of smaller leak losses (as occur in normal operation in spite of the sealing elements), the further sensor measures only very small quantities of subsequently-pumped gas. If a larger leakage occurs, a quantity of re-supplied air or gas that is a great deal larger is required to maintain the constant overpressure, which quantity the further sensor can measure. Given large leakages a pressure loss possibly occurs nevertheless, which the pressure sensor measures. The measurement values of both sensors can be processed by the alarm emitter so that an alarm signal is emitted under predetermined conditions. Alternatively, it can be sufficient when the measurement values of only one of the two sensors (for example of the further sensor) are used.

The pump can be, for example, a compressor.

The quench tube preferably is filled with dry gas or dry air, possibly supplies by the pump. Damages due to condensation of water or corrosion are thereby prevented. Specifically in the case of a slight overpressure at which the same slight quantity of new gas is supplied given slight leak quantities, the use of air at normal humidity can cause a noteworthy quantity of moisture to accumulate in the quench tube over time, which is not desirable. The device thus is additionally protected by only dry air or dry gas being introduced.

The sealing elements can be burst (rupture) discs, for example made of carbon, or thin (preferably elastic) films or foils. For the most part burst discs are used on the magnet side. If a quench occurs, the vaporized gas generates an overpressure such that the burst disc ruptures. IF a thin, elastic film is used, a cutting element for slicing the film at a predetermined pressure in the event of a quench can be associated with the film. For the most part the cutting element is thus arranged behind the film. Given an overpressure the film then expands in the direction of the cutting element. Upon reaching a predetermined overpressure the film then reaches the cutting element which cuts it. It can thus be precisely predetermined at which pressure the film is opened. Without a cutting element this would not be possible.

DESCRIPTION OF THE DRAWINGS

The single FIGURE schematically illustrates an embodiment of an inventive device.

DESCRIPTION OF THE PREFERRED EMBODIMENTS

The FIGURE shows a magnet 2 located within an indicated building 1, at which magnet the inventive device is connected for dissipation of gases created in the event of a quench of the magnet. This device has a quench tube 3 that is separated from the magnet by a burst disc 4. In the case of a quench an overpressure arises in the magnet 2 such that the burst disc 4 ruptures. The quench tube 3 leads out from the building 1. Externally it is sealed with a film 5 that is both thin and elastic. A blade 6 (schematically indicated) is provided outside in front of the film. Upon a predetermined overpressure in the quench tube 3 that arises in the quench tube 3 in the event of a quench after the bursting of the burst disc 4, the film is expanded such that the blade 6 slices it and the gas vaporized at the magnet can escape to the atmosphere.

The quench tube is connected with a compressor 8 via a feed line 7. By supplying air (preferably dry air, alternatively a foreign gas, for example nitrogen) the compressor 8 externally causes a certain slight overpressure to be constantly maintained in the quench tube 3. A pressure sensor 9 measures the pressure in the quench tube. The compressor 8 is activated based on the data of this pressure sensor 9, as is represented by the arrow 10. Should the pressure in the quench tube 3 thus be too low, new air is supplied by the compressor 8. A discharge sensor 11 that measures the quantity of the re-supplied air is provided at the feed line 7. Both the discharge sensor 11 and the pressure sensor 9 communicate with an alarm emitter 12 that compares the measurement values of the two sensors with predetermined thresholds.

For examples if a leak occurs in the quench tube 3, a much larger quantity of air must be re-supplied to maintain the slight overpressure. This is measured by the sensor 11. Since a dropping pressure is also registered due to the leak, the alarm emitter determines that a leakage exists and outputs an alarm signal to operating personnel. The data acquisition occurs continuously, meaning that the functionality of the quench tube 3 is continuously checked.

Although modifications and changes may be suggested by those skilled in the art, it is the intention of the inventor to embody within the patent warranted hereon all changes and modifications as reasonably and properly come within the scope of his contribution to the art.

I claim as my invention:

1. An emergency exhaust device for a superconducting magnet, comprising:

a quench tube having a first end adapted to interact with a superconducting magnet, and a second, opposite end adapted to communicate with ambient atmosphere, said quench tube being configured to dissipate gases created upon an occurrence of a quench of said superconducting magnet by providing a path for said gases to the ambient atmosphere;

first and second sealing elements disposed in said quench tube and closing a segment of said quench tube therebetween;

a sensor disposed to interact with an interior of said segment of said quench tube closed by said first and second sealing elements, said sensor emitting a sensor output representing an impermeability of said segment of said quench tube; and an alarm emitter in communication with said sensor to receive said sensor output therefrom, said alarm emitter emitting an alarm signal if said sensor output indicates a leakage of said segment.

2. A device as claimed in claim 1 comprising a pump in communication with said segment of said quench tube that fills said segment of said quench tube with a predetermined gas, and wherein said sensor is a sensor that measures a proportion of a foreign gas in said predetermined gas.

3. A device as claimed in claim 1 wherein said segment of said quench tube has an overpressure therein, exceeding atmospheric pressure, and wherein said sensor is a pressure sensor that senses a pressure drop in said segment of said quench tube.

4. A device as claimed in claim 3 comprising a pump in communication with said segment of said quench tube that maintains said segment of said quench tube at said overpressure.

5. A device as claimed in claim 4 wherein said pump supplies a predetermined gas to said segment of said quench tube to maintain said overpressure, and wherein said device comprises a further sensor connected to said alarm emitter, that detects a proportion of a foreign gas in said predetermined gas.

6. A device as claimed in claim 5 wherein said pump is a compressor.

7. A device as claimed in claim 1 wherein said segment of said quench tube is filled with a dry gas.

8. A device as claimed in claim 1 wherein at least one of said first and second sealing elements is a burst disk.

9. A device as claimed in claim 1 wherein at least one of said first and second sealing elements is a thin elastic film.

10. A device as claimed in claim 9 comprising an actuatable cutting element disposed relative to said film to rupture said film by slicing said film upon an occurrence of a predetermined pressure that occurs upon a quench in said segment of said quench tube.

11. A device as claimed in claim 1 wherein said second sealing element is disposed at, and seals, said end of said quench tube in communication with ambient atmosphere.

* * * * *